US006255777B1

(12) United States Patent
Kim et al.

(10) Patent No.: US 6,255,777 B1
(45) Date of Patent: Jul. 3, 2001

(54) CAPILLARY ELECTRODE DISCHARGE PLASMA DISPLAY PANEL DEVICE AND METHOD OF FABRICATING THE SAME

(75) Inventors: Seong I. Kim, Northvale; Erich E. Kunhardt, Hoboken, both of NJ (US)

(73) Assignee: Plasmion Corporation, Hoboken, NJ (US)

( * ) Notice: Subject to any disclaimer, the term of this patent is extended or adjusted under 35 U.S.C. 154(b) by 0 days.

(21) Appl. No.: 09/108,403

(22) Filed: Jul. 1, 1998

(51) Int. Cl.[7] ..... H01J 17/49

(52) U.S. Cl. ..... 313/582; 313/581; 313/585; 313/586

(58) Field of Search ..... 313/582, 581, 313/586, 585, 584, 587

(56) References Cited

U.S. PATENT DOCUMENTS

| | | | | |
|---|---|---|---|---|
| 3,921,021 | | 11/1975 | Glaser et al. | 313/188 |
| 3,983,445 | * | 9/1976 | Yasuda | 313/485 |
| 5,414,324 | | 5/1995 | Roth et al. | 315/111.21 |
| 5,446,344 | | 8/1995 | Kanazawa | 315/169.4 |
| 5,510,678 | | 4/1996 | Sakai et al. | 315/58 |
| 5,701,056 | | 12/1997 | Shinohara | 313/584 |
| 5,818,168 | * | 10/1998 | Ushifusa et al. | 313/582 |
| 5,872,426 | | 2/1999 | Kunhardt et al. | 313/582 |
| 6,005,349 | | 12/1999 | Kunhardt et al. | 315/111.21 |

FOREIGN PATENT DOCUMENTS

| | | |
|---|---|---|
| 0 031 233A | 7/1981 | (EP) . |
| 195 42 426A | 5/1996 | (EP) . |
| 48-90675 | 11/1973 | (JP) . |
| 49-65180 | 6/1974 | (JP) . |
| 50-159246 | 12/1975 | (JP) . |
| 51-85371 | 7/1976 | (JP) . |
| 52-11757 | 1/1977 | (JP) . |
| 52-142964 | 11/1977 | (JP) . |
| 54-136172 | 10/1979 | (JP) . |
| 6-176699 | 6/1994 | (JP) . |
| 9-90899 | 4/1997 | (JP) . |
| 9-283034 | 10/1997 | (JP) . |

* cited by examiner

*Primary Examiner*—Vip Patel
*Assistant Examiner*—Karabi Guharay
(74) *Attorney, Agent, or Firm*—Morgan, Lewis & Bockius LLP

(57) ABSTRACT

The present invention provides a capillary electrode discharge plasma display panel device and method of fabricating the same including first and second substrates a first electrode on the first substrate, a second electrode on the second substrate, a pair of barrier ribs connecting the first and second substrates, a discharge charge chamber between the first and second substrates defined by the barrier ribs, and a dielectric layer on the first substrate including the first electrode, the dielectric layer having a capillary to provide a steady state UV emission in the discharge chamber.

43 Claims, 9 Drawing Sheets

AC BARRIER TYPE

CAPILLARY ELECTRODE DISCHARGE

CAPILLARY ELECTRODE DISCHARGE PLASMA DISPLAY PANEL DEVICE AND METHOD OF FABRICATING THE SAME

BACKGROUND OF THE INVENTION

1. Field of the Invention

The present invention relates to a plasma display panel device and method of fabricating the same, and more particularly, to a plasma display panel device having micro-channels or capillaries connecting an electrode. Although the present invention is suitable for a wide scope of applications, it is particularly suitable for generating a high density ultraviolet (UV) emission, thereby significantly reducing driving voltage and turn-on time.

2. Discussion of the Related Art

Plasma display panel ("PDP") devices use gas discharges to convert electric energy into light. Each pixel in a PDP device corresponds to a single gas-discharge site and the light emitted by each pixel is controlled electronically by the video signal that represents the image.

Many structures for color plasma displays have been suggested since the 1980's, but only three are still in contention: the alternating current matrix sustain structure; the alternating current coplanar sustain structure; and the direct current with pulse-memory drive structure.

Generally, PDP is the choice in flat panel display technologies for large size display devices typically larger than 40" diagonal. Extensive research toward the PDP devices has been done to increase brightness, lower driving voltage, and reduce response time of the devices since a proto-type of PDP has been developed. These goals can be achieved by maximizing the efficiency of the UV emission from the glow discharge.

Most of the PDP devices utilizes a high pressure AC barrier type discharge. One example of the conventional high pressure AC barrier type discharge is disclosed in U.S. Pat. No. 5,701,056as shown in FIG. 1. A conventional plasma display panel device has a transparent front substrate 101 and a rear substrate 110 facing each other. A plurality of transparent electrodes 102 are formed on each of the front substrate 101, and a bus electrode 111 is on each of the transparent electrodes 102. The transparent electrode 102 and the bus electrodes 111 are covered with a thick insulating layer 103 and a protection layer 104 in this order. The transparent insulating layer 103 and the protection layer 104 comprises lead glass having a low fusing point and magnesium oxide (MgO).

A plurality of data electrodes 108 are formed on the rear substrate 110. A plurality of chambers 112 are defined by first, second, and third partition walls 105*a*, 105*b* (not shown), and 106, and the first and third partition walls have widths $W_H$ and $W_D$, respectively. A white-color insulating layer 107 is formed on the rear substrate 110 including the data electrode 108. Further, a fluorescent material 109 is formed on the third partition wall 106 and the white-color insulating layer 107.

U.S. Pat. No. 5,414,324 has suggested another structure for generating a high pressure glow discharge plasma as shown in FIG. 2. An electrode 10 is made of copper plate having a representative square plan dimension of 25 cm×25 cm. The integral metallic units comprising plates 10 and tubing 11 are covered with a high dielectric insulating layer 14. In this structure, the dielectric insulating layer 14 is to prevent a high current arc mode from the discharge. However, the dielectric insulating layer 14 consumes a large amount of the electric field. Moreover, a significant fraction of the electric field is applied across the dielectric insulating layer, so that the electric field cannot be applied effectively throughout the PDP device.

SUMMARY OF THE INVENTION

Accordingly, the present invention is directed to a plasma display panel device and method of fabricating the same that substantially obviates one or more of the problems due to limitations and disadvantages of the related art.

An object of the present invention is to provide a high density UV emission in a PDP operated in an AC or DC mode.

Another object of the present invention is to provide reduced driving voltage and short response time.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a plasma display panel device includes first and second substrates, a first electrode on the first substrate, a second electrode on the second substrate, a pair of barrier ribs connecting the first and second substrates, an electric charge chamber between the first and second substrates defined by the barrier ribs, and a dielectric layer on the first substrate including the first electrode, the dielectric layer having a channel to provide a steady state UV emission in the electric charge chamber.

In another aspect of the present invention, a plasma display panel device includes first and second substrates, a first electrode on the first substrate, a second electrode on the second substrate, a pair of barrier ribs connecting the first and second substrates, an electric charge chamber between the first and second substrates, and a UV-visible photon conversion layer between the first and second substrate, the UV-visible photon conversion layer having at least one channel to provide a steady state UV emission in the electric charge chamber.

In another aspect of the present invention, a plasma display panel device includes first and second substrates, a first electrode on the first substrate, a first dielectric layer on the first electrode, a second electrode on the first dielectric layer, a second dielectric layer on the second electrode, a third electrode on the second substrate, a UV-visible photon conversion layer on the second substrate including the third electrode, a pair of barrier ribs connecting the first and second substrates, and first and second electric charge chambers between the first and second substrates defined by the barrier ribs.

In another aspect of the present invention, a plasma display panel device includes first and second substrates, first and second electrodes on the first substrate, a first dielectric layer on the first substrate including the first and second electrodes, a third electrode on the first dielectric layer, a fourth electrode on the second substrate layer, a UV-visible photon conversion layer on the second substrate including the fourth electrode, a pair of barrier ribs connecting the first and second substrates, a first electric charge chamber between the first and second substrates defined by the barrier ribs, and a second electric charge chamber between the first and second electrodes in the first dielectric layer.

In another aspect of the present invention, a method of fabricating a plasma display panel device having first and second substrates, comprising the steps of forming a first electrode on the first substrate, forming a dielectric layer on the first substrate including the first electrode, and forming at least one channel in the dielectric layer to expose the first electrode.

In a further aspect of the present invention, a method of fabricating a plasma display panel device having first and second substrates, comprising the steps of forming a first electrode on the first substrate, forming a UV-visible photon conversion layer on the first substrate including the first electrode, and forming at least one channel in the UV-visible photon conversion layer to expose the first electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the inventing and together with the description serve to explain the principle of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Capillary Plasma Electrode Discharge ("CPED") PDP device of the present invention utilizes a new type of electrical discharge in a gas in which the electrodes produce a high density plasma. Plasma is generated in capillary tubes placed in front of and with the axis perpendicular to metal electrodes. A diameter of the plasma electrode is determined by the number of capillaries that are combined in parallel, as well as by their separation. The density and diameter of the capillaries can be varied for optimizing the discharge characteristics.

Figure 1:
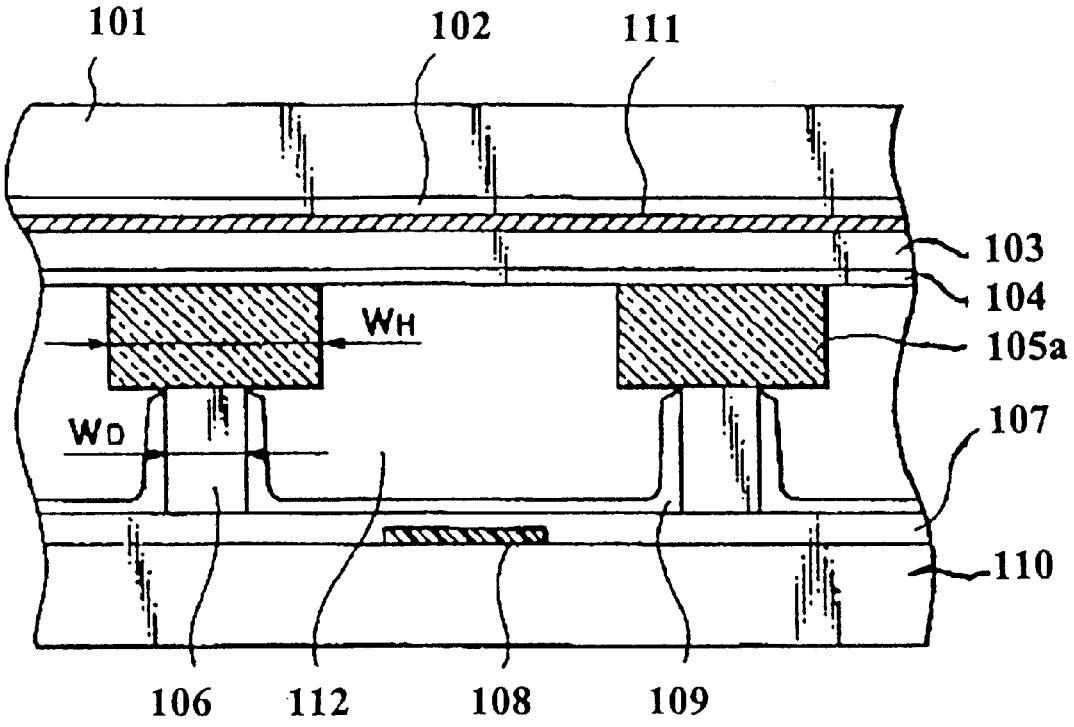
FIG. 1 is a schematic view of a plasma display panel device according to background art.
Figure 2:
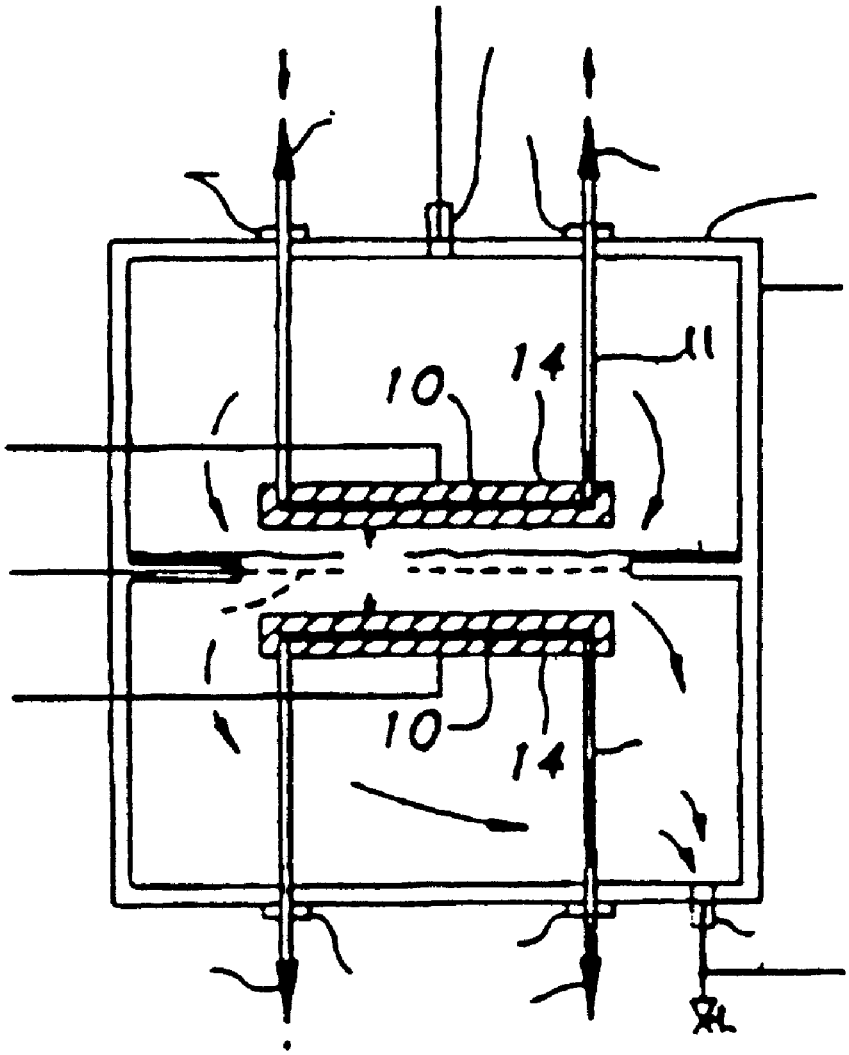
FIG. 2 is a schematic view of a plasma display panel device according to another background art.
Figure 3A:
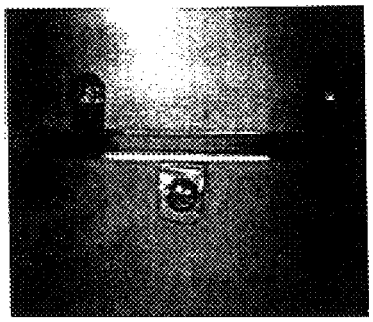
FIGS. 3A to 3C are photographs illustrating a plasma discharge in an AC operated PDP according to a conventional PDP device and the present invention.
Figure 3B:
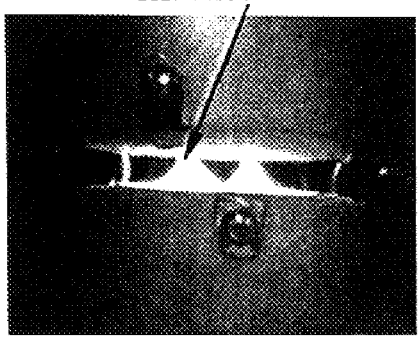
Figure 3C:
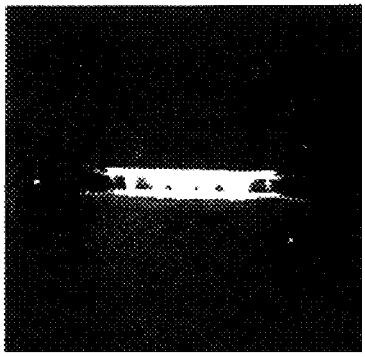

FIGS. 3A to 3C illustrate comparison of the intensity of the plasma discharge between the conventional AC barrier type and the capillary electrode discharge of the present invention. Both AC and unipolar pulses are used to power the electrodes. As shown in FIGS. 3B and 3C, a plasma jet emanating from the capillaries is clearly visible and much more brighter than that in FIG. 3A. Accordingly, the intensity of the discharge is significantly larger than that of the conventional AC barrier discharge for the same conditions.

Figure 4A:
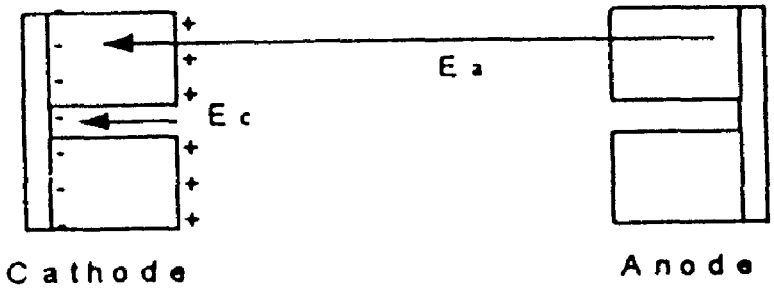
FIGS. 4A to 4C are schematic views showing an evolution of a plasma discharge of the present invention.
Figure 4B:
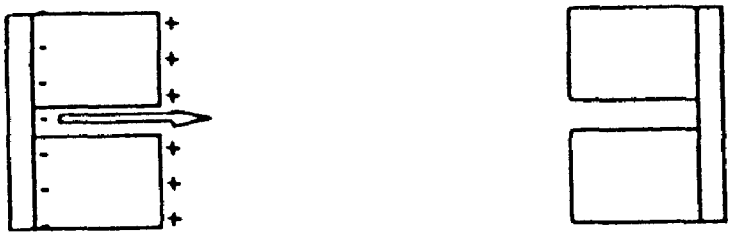
Figure 4C:
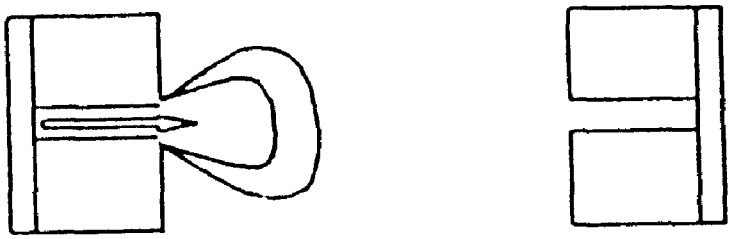

These features of the capillary discharge of the present invention are schematically illustrated in FIGS. 4A to 4C. FIG. 4A shows a field inside the capillary Ec generating a high field discharge starting from the metal electrode and an applied electrode field Ea. A high density plasma in the capillary emerges from the end of the capillary into the gap serving as an electrode for a main discharge. The field inside the capillary does not collapse after forming a streamer discharge. This is due to a high electron-ion recombination at the wall requiring a large production rate on the axis (and therefore a high field) in order to sustain the current. A double layer exists at the interface of the capillary plasma and the main discharge. By selecting a ratio of the diameter d of the capillary to the length of the capillary tube L, a steady state plasma discharge can be sustained, as shown in FIG. 4C. A dielectric layer is not necessary to cover an anode if unipolar operation is desired.

Figure 5A:
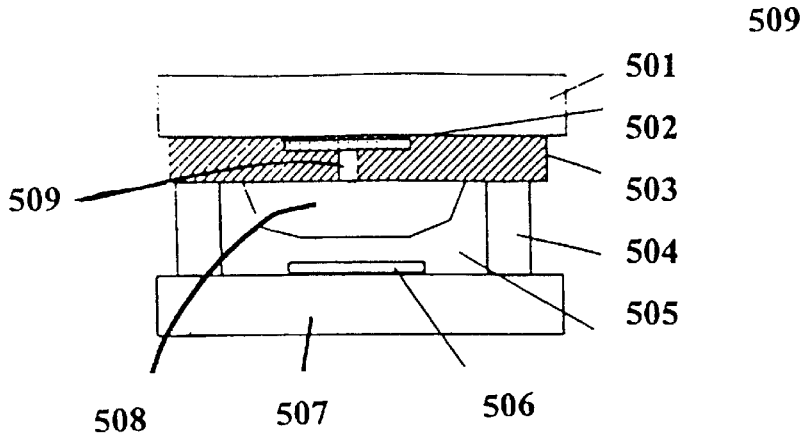
FIGS. 5A and 5B are horizontal and vertical cross-sectional views of a plasma display panel device according to a first embodiment of the present invention.
Figure 5B:
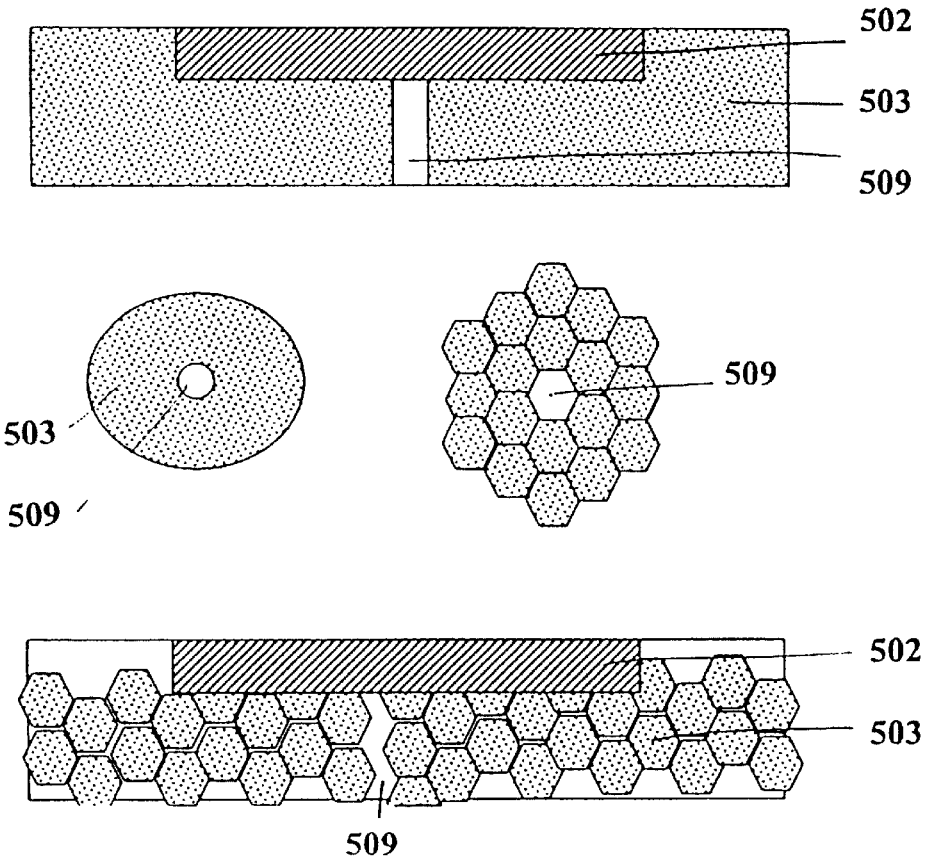

A plasma display panel (PDP) device according to a first embodiment of the present invention will be described with reference to FIG. 5A. As shown in FIG. 5A, a PDP device includes a front glass panel 501, and a rear glass panel 507 disposed facing each other. An electrode 502 is formed on the front glass panel 501. A dielectric layer 503 is formed on the front glass panel 501 including the electrode 502. If necessary, a magnesium oxide (MgO) layer may be formed on the dielectric layer 503. On the rear glass panel 507, a counter electrode 506 is formed thereon. The counter electrode 506 may be disposed at the center of the rear glass panel 507. A pair of barrier ribs 504 connect the front glass panel 501 and the rear glass panel 507. A UV-visible photon conversion layer 505, for example, a phosphor layer, is formed covering the counter electrode 506 between the front glass panel 501 and the rear glass panel 507. A electric charge chamber 508 is defined by the barrier ribs 504 between the front glass panel 501 and the rear glass panel 507. Typically, the electric charge chamber 508 is filled with an inert gas mixture such as Xenon (Xe) to generate a UV emission. Further, in this embodiment, the dielectric layer 503 has a channel 509 to expose the electrode 502 to the electric charge chamber 508, so that a steady state UV emission is obtained in the electric charge chamber. A horizontal cross-section of the channel 509 may have a circular or polygonal shape, and a vertical cross-section may be have a straight or crooked shape, as shown in FIG. 5B. A dimension of the channel may be defined by the following equation:

$$1/100<D/L<1$$

wherein D is a largest cross-section width of the channel and L is a length of the dielectric layer.

Alternatively, a dimension of the channel is an order of an electron mean free path or larger than an electron mean free path.

Figure 6A:
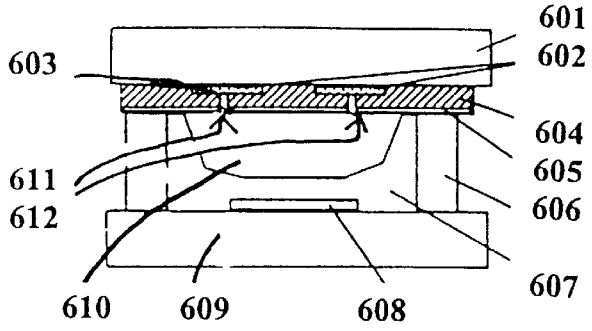
FIGS. 6A and 6B are horizontal and vertical cross-sectional views of a plasma display panel device according to a second embodiment of the present invention.
Figure 6B:
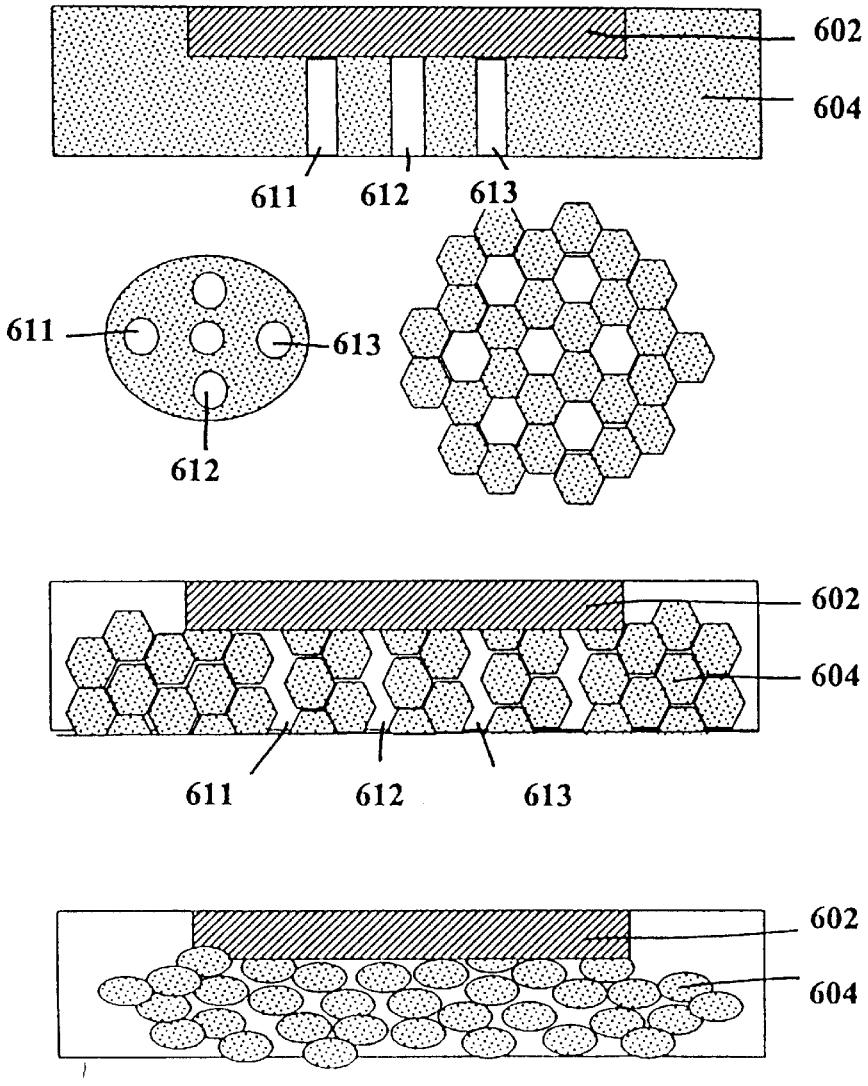

FIG. 6A is a cross-sectional view showing a PDP device according to a second embodiment of the present invention. The second embodiment of the present invention includes a front glass panel 601, a rear glass panel 609, and first and second electrodes 602 and 603 on the front glass panel 601. A transparent dielectric layer 604 is formed on the front glass panel 601 including the first and second electrodes 602 and 603. Although a magnesium oxide (MgO) layer 605 is not required in the present invention, a MgO layer 605 may be formed on the transparent dielectric layer 604. A pair of barrier ribs 606 connect the first and second glass panels 601 and 609 and define an electric charge chamber 610. An address electrode 608 is positioned on the center of the rear glass panel 609. Further, a UV-visible photon conversion layer 607, such as a phosphor layer, is formed on the second glass panel 609 including the address electrode 608. In this embodiment, first and second channels 611 and 612 through the transparent dielectric layer 604 are formed to expose the first and second electrodes 602 and 603 to provide a steady state UV emission as described in FIGS. 4A to 4C. Dimensions of the first and second electrodes 602 and 603 may be the same as the dimension disclosed in the first embodiment. A horizontal cross-section of the channels 611 may have a circular shape or polygonal shape, and a vertical cross-section may have a straight or crooked shape, as shown in FIG. 6B. The electric charge chamber 610 is filled with an inert gas such as Xenon (Xe).

Figure 7:
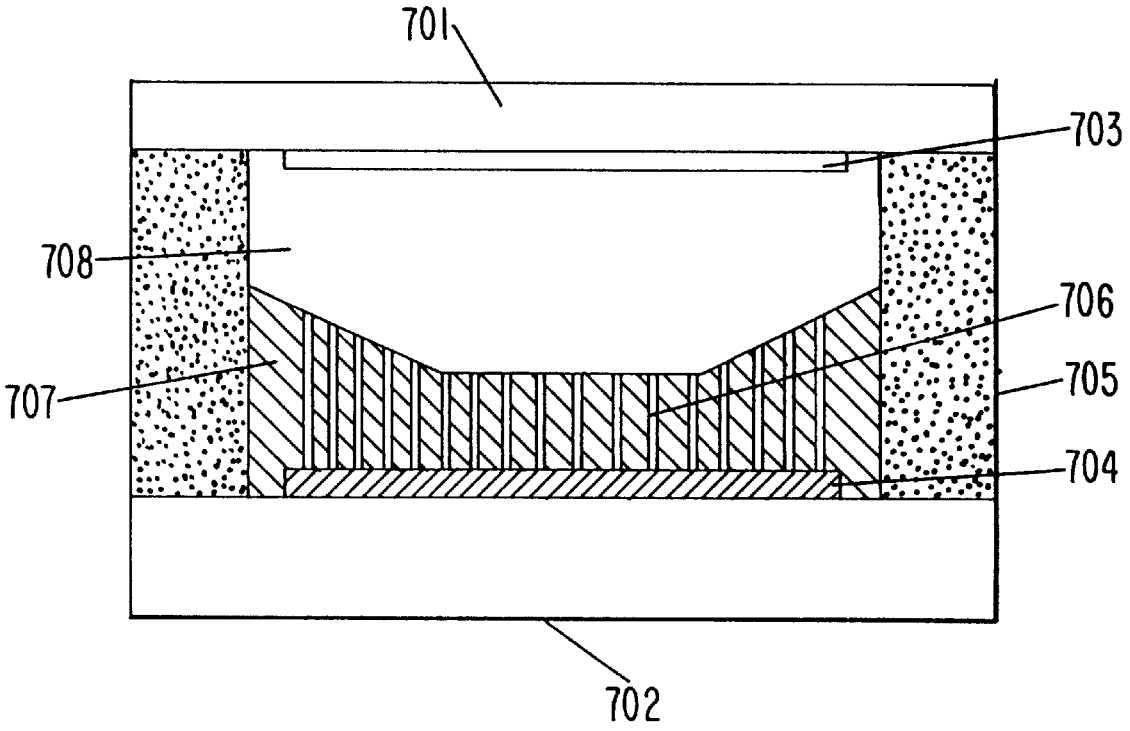
FIG. 7 is a cross-sectional view of a plasma display panel device according to a third embodiment of the present invention.

FIG. 7 illustrates a cross-sectional view of a PDP device according to a third embodiment of the present invention. The present embodiment includes front and back glass panels 701 and 702 facing each other, a transparent electrode 703 such as an indium tin oxide (ITO) layer on the front glass panel 701. The transparent electrode 703 acts as an anode electrode in a DC operation. A conductive electrode 704 is formed on the back glass panel 702 and acts as a cathode electrode in a DC operation. A UV-visible photon conversion layer 705, such as a phosphor layer, is formed on the back glass panel 702 including the conductive electrode 704. The UV-visible photon conversion layer 705 has a thickness in the range of about 10 to 50 $\mu$m. A pair of barrier ribs 707 connect the front and back glass panels 701 and 702 and define a electric charge chamber 708.

In the present embodiment, a plurality of channels 706 are formed through the UV-visible photon conversion layer 705 to expose the conductive electrode 704 to the electric charge chamber 708. A number of channels in the UV-visible photon conversion layer 705 is preferably in the range of 1 to 100. A vertical cross-section of the channels 706 may have a circular shape or polygonal shape, and it may be straight or crooked, as shown in FIG. 7. A dimension of each channel may be defined by the following equation:

$$1/100<D/L<1$$

wherein D is a largest cross-section width of the channel and L is a length of the UV-visible photon conversion layer.

Figure 8A:
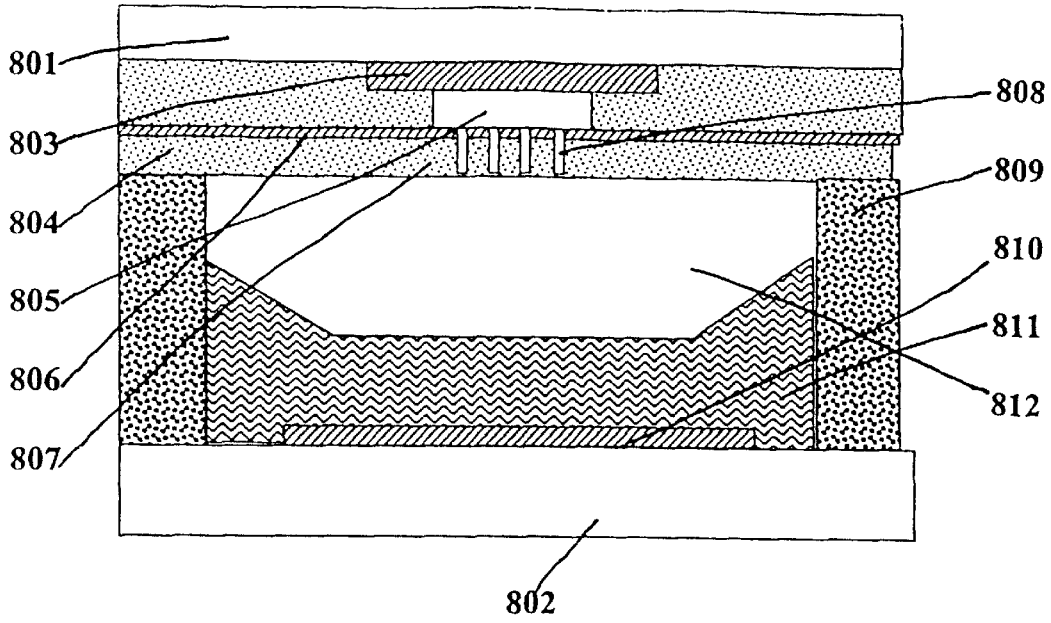
FIGS. 8A and 8B are cross-sectional views of a plasma display panel device according to a fourth embodiment of the present invention.
Figure 8B:
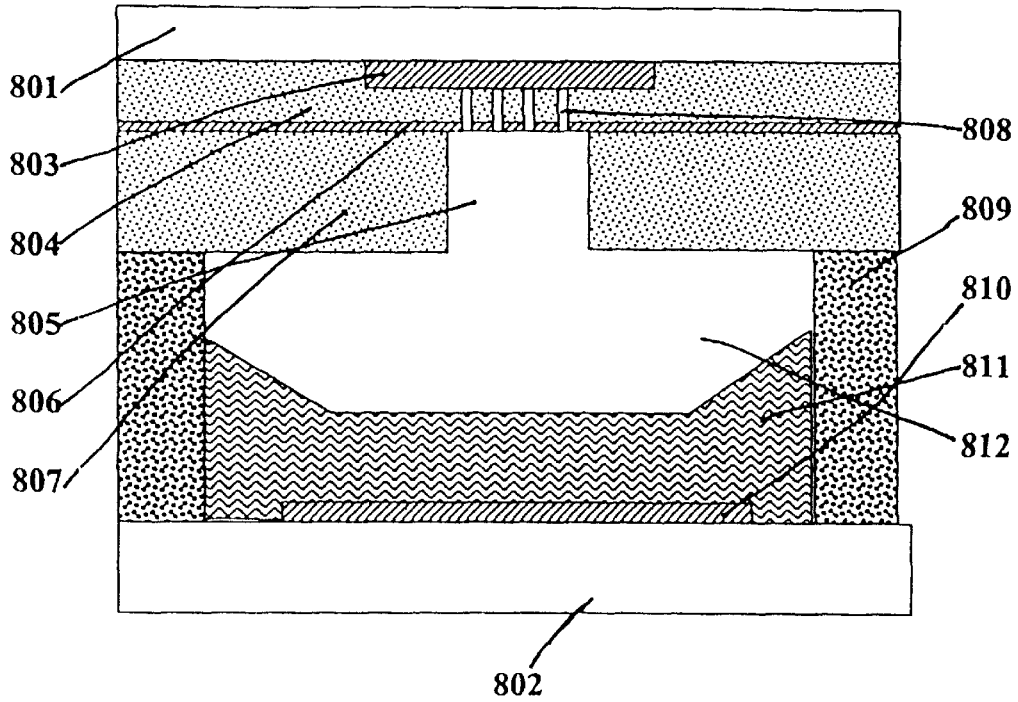

FIGS. 8A and 8B are a fourth embodiment of the present invention which reduces even further the response time of a PDP device. The present embodiment includes front and rear glass panels 801 and 802 facing each other. A first electrode 803 is formed on the front glass panel 801. A first dielectric layer 804 is formed on the front glass panel 801 including the first electrode 803. A first electric charge chamber 805 is defined in the first dielectric layer 804. A second electrode 806 is formed on the first dielectric layer including the first electric charge chamber 805. Further, a second dielectric layer 807 is formed on the second electrode 806. A pair of barrier ribs 809 connect the first and second glass panels 801 and 802 and define a second electric charge chamber 812. Alternatively, the first electric charge chamber 805 may be formed in the second dielectric layer 807 as shown in FIG. 8B. A third electrode 810 is disposed at the center of the rear glass panel 802. A UV-visible photon conversion layer 811 such as a phosphor layer is formed on the rear glass panel 802 including the third electrode 810. Channels 808 through the second dielectric layer 807 and the second electrode 806 are formed to connect the first and second electric charge chambers 805 and 812. In the present embodiment, the first electric charge chamber 805 provides a pilot discharge so that turn-on time is reduced for a steady state UV emission. A cross-section of the channels 808 may have the same dimension and shape as explained in the previous embodiments. The first and second electric charge chambers connected through the channel 808 are filled with an inert gas, such as Xenon (Xe).

Figure 9:
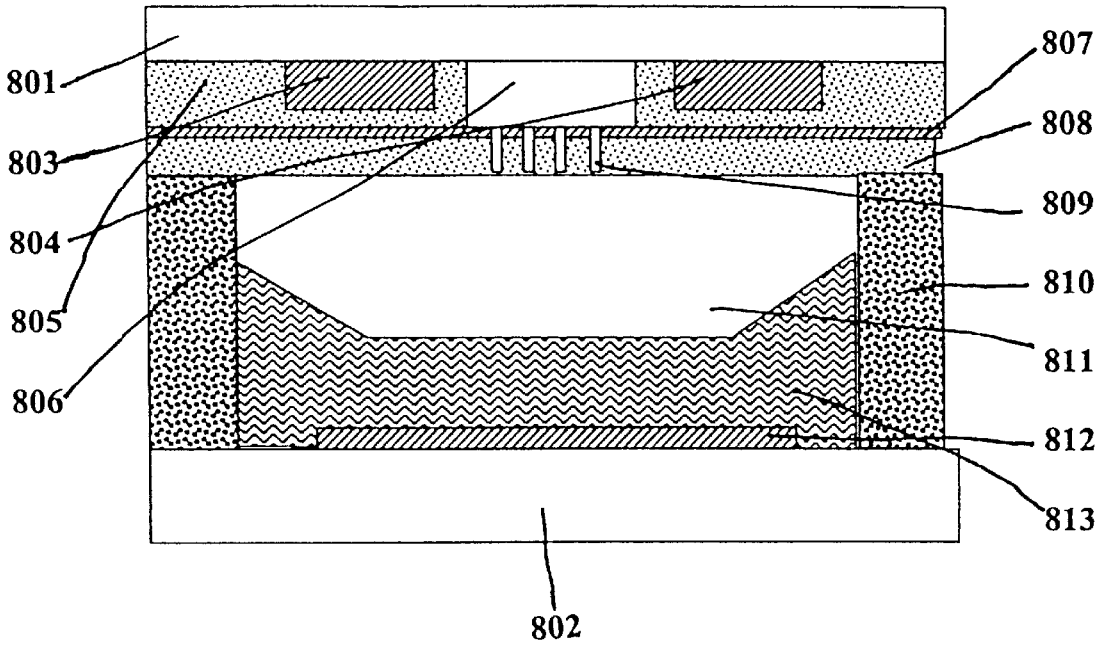
FIG. 9 is a cross-sectional view of a plasma display panel device according to a fifth embodiment of the present invention.

FIG. 9 is a fifth embodiment of the present invention showing another structure to reduce the turn-on time for a PDP device. A PDP device according to the present embodiment comprises first and second glass panels 801 and 802, first and second electrodes 803 and 804 on the first glass panel 801, a first dielectric layer 805 on the first glass panel 801 including the first and second electrodes 803 and 804. A first electric charge chamber 806 is formed in the first dielectric layer 805 to provide a pilot discharge, so that it shortens turn-on time for a main discharge. The PDP device according to the present embodiment further includes a third electrode 807 on the first dielectric layer 805 including the first electric charge chamber 806 and a second dielectric layer 808 on the third electrode 807. A plurality of channels 809 through the second dielectric layer 808 and the third electrode 807 are connected to the first electric charge chamber 806, so that the channels provide a steady state UV emission for the PDP device. A pair of barrier ribs 810 connect the first and second glass panels 801 and 802, thereby defining a second electric charge chamber 811. A fourth electrode 812 is formed on the second glass panel 802. A UV-visible photon conversion layer 813 is formed on the second glass panel 802 including the fourth electrode 812.

A method of fabricating a plasma display panel device according to the present invention is now explained as follows:

For example, one of methods of fabricating a plasma display panel device is described with reference to FIG. SA. First, a first electrode 502 is formed on the first substrate 501. Subsequently, a dielectric layer is formed on the first substrate including the first electrode. At least one channel 509 in the dielectric layer is formed to expose the first electrode 502 to an electric charge chamber 508. In this process, the channel is formed by one of a laser machining, wet etching, or dry etching.

In another method of fabricating a plasma display panel device, a first electrode 704 is initially formed on the first substrate 702 as shown in FIG. 7. The first electrode 704 may be formed of a metal electrode. Next, a UV-visible photon conversion layer, such as a phosphor layer, is formed on the first substrate including the first electrode 704. Then, at least one channel 706 is formed in the UV-visible photon conversion layer to expose the first electrode to an electric charge chamber 708. Similarly, the channel 706 in the UV-visible photon conversion layer is formed by one of a laser machining, wet etching, or dry etching.

A plasma display panel device and method of fabricating the same of the present invention has the following advantages.

Since the field in the capillary does not collapse, a discharge having a high electric field is maintained in the capillary. As a result, much enhanced brightness is obtained with the CPED plasma display panel device of the present invention.

The PDP of the present invention is operated both in an Ac or DC mode and has a discharge operation voltage less than 200 V. This is possible because a breakdown voltage is lowered by using a large field across the dielectric layer in the early phase of a cycle for generating electron avalanches in the capillary. Since a dielectric buried electrode is not required, the device structure is much simpler than the conventional PDP structures.

A life time of the device is much improved since a MgO layer or a current limiting resistor is not necessary for the present invention. Further, unlike the conventional AC operated PDP, the response time is very short because a time for dielectric charging is eliminated from the response time. Accordingly, the fabrication cost is much reduced because the present invention has a simpler structure and better efficiency in generating a steady state UV emission.

It will be apparent to those skilled in the art that various modifications and variations can be made in a plasma display panel device and method of fabricating the same of the present invention without departing from the spirit or scope of the invention. Thus, it is intended that the present invention cover the modifications and variations of this invention provided they come within the scope of the appended claims and their equivalents.

What is claimed is:

1. A plasma display panel device comprising:

first and second substrates;

a first electrode on the first substrate;

a second electrode on the second substrate;

a UV-visible conversion layer on the second substrate including the second electrode wherein the UV-visible photon conversion layer directly contacts the second electrode;

a pair of barrier ribs connecting the first and second substrates;

a discharge chamber between the first and second substrates defined by the barrier ribs; and a dielectric layer on the first substrate including the first electrode, wherein the dielectric layer has a capillary so that a portion of the first electrode faces toward the discharge chamber through the capillary, thereby providing a steady sate UV emission in the discharge chamber.

2. The plasma display panel device according to claim 1, further comprising a magnesium oxide (MgO) layer on the dielectric layer.

3. The plasma display panel device according to claim 1, wherein UV-visible photon conversion layer is located between the first and second substrates.

4. The plasma display panel device according to claim 3, wherein the UV-visible photon conversion layer includes a phosphor layer.

5. The plasma display panel device according to claim 1, wherein the capillary includes a circular shape or polygonal shape in a horizontal cross-section.

6. The plasma display panel device according to claim 1, wherein the capillary includes a straight or crooked shape in a vertical cross-section.

7. The plasma display panel device according to claim 1, wherein a size of the capillary is defined by the following equation:

$$1/100<D/L<1$$

wherein D is a largest cross section width of the capillary, and L is a length of the dielectric layer.

8. The plasma display panel device according to claim 1, wherein the discharge chamber is filled with an inert gas mixture including Xenon (Xe).

9. The plasma display panel device according to claim 1, wherein the second electrode is positioned substantially at a center of the second substrate.

10. The plasma display panel device according to claim 1, wherein the second electrode includes an address electrode.

11. The plasma display panel device according to claim 1, wherein the first electrode includes at least two electrodes on the first substrate.

12. The plasma display panel device according to claim 1, wherein a size of the capillary is an order of an electron mean free path or larger than the electron mean free path, wherein the electron mean free path is in the range of 1 to 100 $\mu$m under a vacuum condition between 300 and 760 Torr.

13. A plasma display panel device comprising:

first and second substrates;

a first electrode on the first substrate;

a second electrode on the second substrate;

a pair of barrier ribs connecting the first and second substrates;

a discharge chamber between the first and second substrates; and a UV-visible photon conversion layer on the second substrate including the second electrode, wherein the UV-visible photon conversion layer has at least one capillary and is directly in contact with the second electrode, thereby providing a steady state UV emission in the discharge chamber.

14. The plasma display panel device according to claim 13, wherein a size of the capillary is defined by the following equation:

$$1/100<D/L<1$$

wherein D is a diameter of the capillary, and L is a thickness of the UV-visible photon conversion layer.

15. The plasma display panel device according to claim 13, wherein the discharge chamber is filled with an inert gas mixture including Xenon (Xe).

16. The plasma display panel device according to claim 13, wherein the second electrode is positioned substantially at a center of second substrate.

17. The plasma display panel device according to claim 13, wherein the second electrode includes a cathode electrode.

18. The plasma display panel device according to claim 13, wherein the second electrode includes a conductive electrode.

19. The plasma display panel device according to claim 13, wherein the first electrode includes an anode electrode.

20. The plasma display panel device according to claim 13, wherein the first electrode includes an ITO electrode.

21. The plasma display panel device according to claim 13, wherein the UV-visible photon conversion layer has a thickness in a range of about 10 to 50 $\mu$m.

22. The plasma display panel device according to claim 13, wherein the UV-visible photon conversion layer has a number of channels in a range of 1 to 100.

23. The plasma display panel device according to claim 13, wherein the UV-visible photon conversion layer includes a phosphor layer.

24. The plasma display panel device according to claim 13, wherein the device has a discharge operation voltage less than 200 V.

25. The plasma display panel device according to claim 13, wherein the capillary includes a circular shape or polygonal shape in a horizontal cross-section.

26. The plasma display panel device according to claim 13, wherein the capillary includes a straight or crooked shape a vertical cross-section.

27. A plasma display panel device comprising:

first and second substrates;

a first electrode on the first substrate;

a first dielectric layer on the first electrode;

a second electrode on the first dielectric layer, wherein the second electrode and the first dielectric layer have at least one capillary;

a second dielectric layer on the second electrode;

a third electrode on the second substrate;

a UV-visible photon conversion layer on the second substrate including the third electrode, wherein the first electrode faces toward the UV-visible photon conversion layer through the capillary;

a pair of barrier ribs connecting the first and second substrates; and first and second discharge chambers between the first and second substrates defined by the barrier ribs.

28. The plasma display panel device according to claim 27, wherein the second dielectric layer and the second electrode have at least one capillary.

29. The plasma display panel device according to claim 27, wherein the first discharge chamber is disposed in the first dielectric layer.

30. The plasma display panel device according to claim 27, wherein the first discharge chamber is disposed in the second dielectric layer.

31. The plasma display panel device according to claim 27, wherein the UV-visible photon conversion layer includes a phosphor layer.

32. The plasma display panel device according to claim 27, wherein the capillary includes a circular shape or polygonal shape in a vertical cross-section.

33. The plasma display panel device according to claim 27, wherein the capillary includes a straight or crooked shape in a vertical cross-section.

34. A plasma display panel device comprising:

first and second substrates;

first and second electrodes on the first substrate;

a first dielectric layer on the first substrate including the first and second electrodes;

a third electrode on the first dielectric layer;

a fourth electrode on the second substrate layer;

a UV-visible photon conversion layer on the second substrate including the fourth electrode;

a pair of barrier ribs connecting the first and second substrates;

a first discharge chamber between the first and second substrates defined by the barrier ribs; and a second discharge chamber between the first and second electrodes in the first dielectric layer.

35. The plasma display panel according to claim 34, wherein the first and second discharge chambers are connected through at least one capillary in the third electrode and the second dielectric layer.

36. The plasma display panel device according to claim 35, wherein the capillary includes a circular shape or polygonal shape in a vertical cross-section.

37. The plasma display panel device according to claim 36, wherein the capillary includes a straight or crooked shape a vertical cross-section.

38. The plasma display panel device according to claim 35, wherein the UV-visible photon conversion layer includes a phosphor layer.

39. A plasma display panel device comprising:

first and second substrates;

a first electrode on the first substrate;

a second electrode on the second substrate;

a pair of barrier ribs connecting the first and second substrates;

a discharge chamber between the first and second substrates defined by the barrier ribs; and a dielectric layer on the first substrate including the first electrode, the dielectric layer having a capillary to provide a steady state UV emission in the discharge chamber, wherein a size of the capillary is defined by the following equation: $1/100<D/L<1$, wherein D is a diameter of the capillary, and L is a thickness of the dielectric layer.

40. A plasma display panel device comprising:

first and second substrates;

a first electrode on the first substrate;

a second electrode on the second substrate;

a pair of barrier ribs connecting the first and second substrates;

a discharge chamber between the first and second substrates; and a UV-visible photon conversion layer between the first and second substrate, the UV-visible photon conversion layer having at least one capillary to provide a steady state UV emission in the discharge chamber, wherein a size of the capillary is defined by the following equation: $1/100<D/L<1$, wherein D is a diameter of the capillary, and L is a thickness of the UV-visible photon conversion layer.

41. A plasma display panel device comprising:

first and second substrates;

a first electrode on the first substrate;

a second electrode on the second substrate;

a pair of barrier ribs connecting the first and second substrates;

a discharge chamber between the first and second substrates; and a UV-visible photon conversion layer between the first and second substrate, the UV-visible photon conversion layer having at least one capillary to provide a steady state UV emission in the discharge chamber, wherein the device has a discharge operation voltage less than 200 V.

42. A plasma display panel device comprising:

first and second substrates;

a first electrode on the first substrate;

a first dielectric layer on the first electrode;

a second electrode on the first dielectric layer;

a second dielectric layer on the second electrode;

a third electrode on the second substrate;

a UV-visible photon conversion layer on the second substrate including the third electrode;

a pair of barrier ribs connecting the first and second substrates; and first and second discharge chambers between the first and second substrates defined by the barrier ribs, wherein the first discharge chamber is disposed in the first dielectric layer.

43. A plasma display panel device comprising:

first and second substrates;

a first electrode on the first substrate;

a first dielectric layer on the first electrode;

a second electrode on the first dielectric layer;

a second dielectric layer on the second electrode;

a third electrode on the second substrate;

a UV-visible photon conversion layer on the second substrate including the third electrode;

a pair of barrier ribs connecting the first and second substrates; and first and second discharge chambers between the first and second substrates defined by the barrier ribs, wherein the first discharge chamber is disposed in the second dielectric layer.

* * * * *